United States Patent [19]

Huang

[11] Patent Number: 5,034,863

[45] Date of Patent: Jul. 23, 1991

[54] DESK LAMP

[76] Inventor: James C. S. Huang, No. 19, Lane 111 Ho Ping Rd. Luchou, Taipei Hsien, Taiwan

[21] Appl. No.: 551,746

[22] Filed: Jul. 12, 1990

[51] Int. Cl.[5] ..... H01R 33/06

[52] U.S. Cl. ..... 362/226; 362/414

[58] Field of Search ..... 362/226, 410, 414, 391

[56] References Cited

U.S. PATENT DOCUMENTS 1,977,378 10/1934 Doane ..... 362/410 X 4,298,919 11/1981 Karasawa ..... 362/226

4,525,773 6/1985 Hesse et al. ..... 362/414 X

*Primary Examiner*—Stephen F. Husar

*Attorney, Agent, or Firm*—Bacon & Thomas

[57] ABSTRACT

A desk lamp which may be easily assembled and disassembled is composed of a base, an arm and a shade, wherein wires extending along the arm and the arm itself have opposite ends which are insertable and removable from corresponding pairs of pins and recesses in the base and shade.

2 Claims, 2 Drawing Sheets

DESK LAMP

BACKGROUND OF THE INVENTION

1. Field of the Invention

This invention relates to a desk lamp, and more particularly to an improved desk lamp which can be assembled and disassembled with ease.

2. Description of the Prior Art

A known desk lamp is composed of three parts, a base, an arm, and a shade, which are always combined to form a single piece. In other words, the known desk lamp is not separable and occupies a large space. It is therefore not convenient to be packaged. Obviously the known desk lamp must be packaged in a large box, thus increasing cost.

In order to overcome this drawback, it is more effective to disassemble the base, arm, and shade into three pieces, which decreases the required space and facilitates packaging.

It is not difficult, of course, to disassemble a lamp. However, there is a question to be considered as to how power supply is transmitted from the base to the shade to light a lamp or a bulb and to avoid disturbance of wires, when the desk lamp is disassembled.

A disassembled desk lamp should also be easily assembled. If not easily assembled, or the operation of assembly required still other tools, such as a screw or a wrench, the utility of the lamp will be discounted and not acceptable.

SUMMARY OF THE INVENTION

It is the objective of this present invention to mitigate and/or obviate the above-mentioned drawbacks in the manner set forth in the description of the preferred embodiment.

The primary objective of the present invention is to provide a desk lamp which can be disassembled and reassembled very easily and transmits power supply perfectly.

Another objective of the present invention is to provide a desk lamp which is composed of a base, an arm, and a shade; wherein the base is provided with a pair of channels on its upper surface to contain a pair of pins extending from the base. The upper surface of the base is covered by a cap which not only engages with the pins but also defines a space which permits the lower end of the arm to be received therein. The arm is provided with a pair of wires which can be inserted into the pins to complete the connection with the base.

The shade is, also provided with a hollow part and a pair of pins on its bottom side to allow an insertion of the upper end of the arm as well as its wires to complete the connection of the shade and the arm.

Further objectives and advantages of the present invention will become apparent as the following detailed description, and the features of novelty which are characterized in the claims annexed to and forming a part of this invention.

DETAILED DESCRIPTION OF THE PREFERRED EMBODIMENTS

Figure 1:
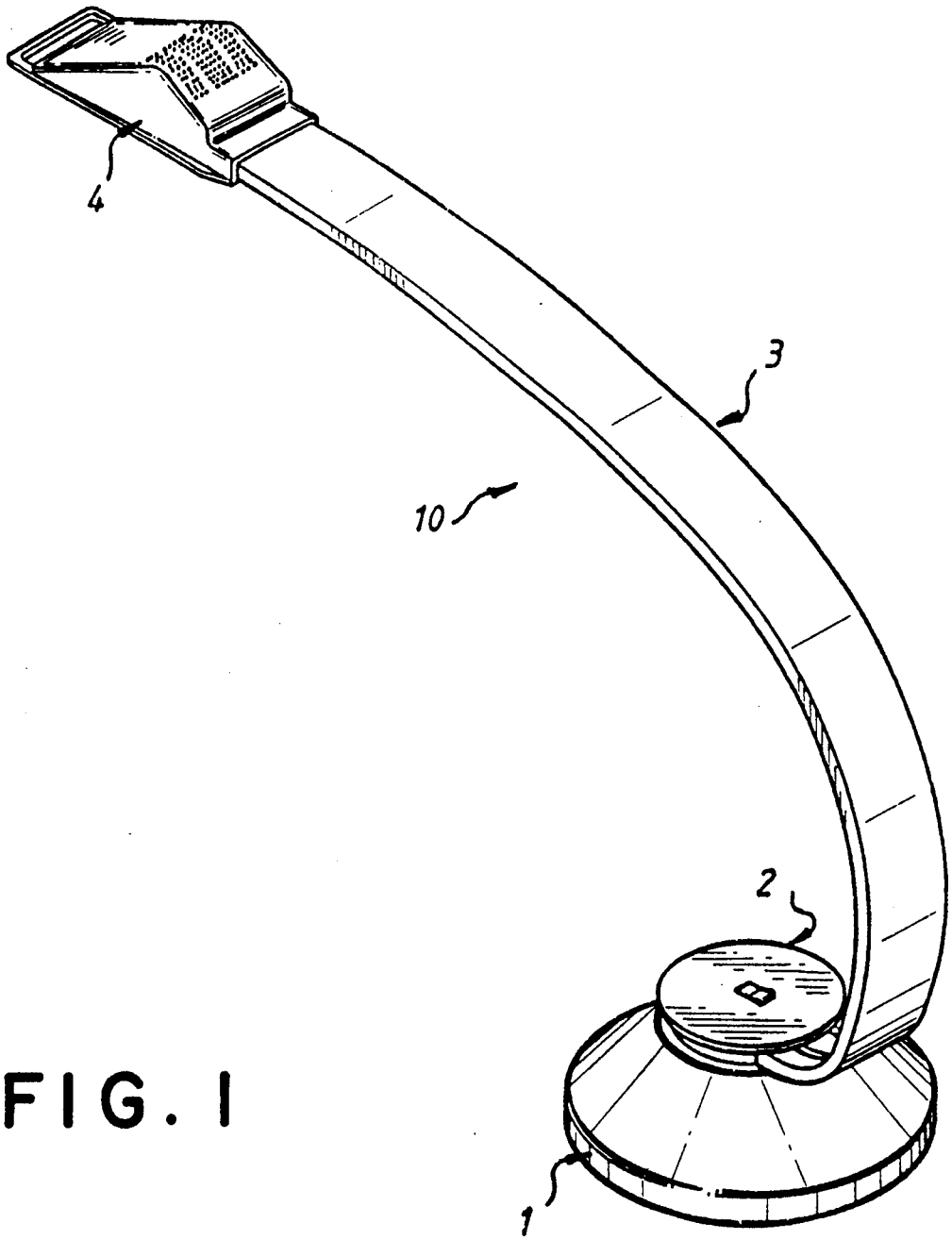
FIG. 1 is a perspective view in accordance with the present invention.
Figure 2:
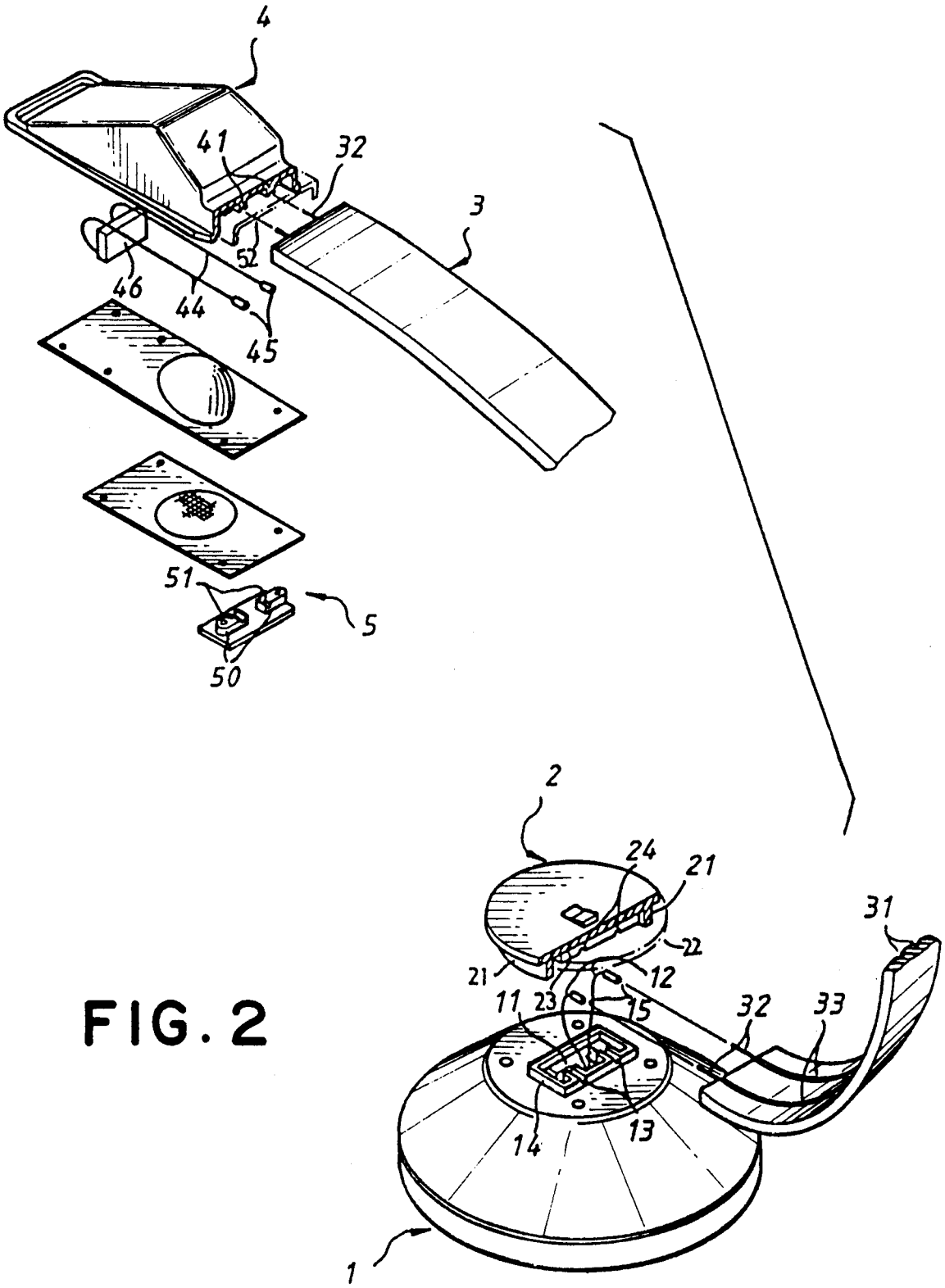
FIG. 2 is an exploded view of FIG. 1 in accordance with the present invention.

A preferred embodiment of a desk lamp (10) is shown in FIGS. 1 and 2. The lamp (10) includes base (1) to support the lamp (10) to stand. A hole (11) is formed in the surface of the base (1) to contain a pair of wires (12) extended from the base (1). The hole (11) is surrounded with a flange (14) which is provided with a pair of channels (13) to receive a respective pair of pins (15) thereon. The pins (15) are connected with the said wires (12).

As in FIG. 2, the base (1) is covered by a cap (2) which is provided with side walls (21) and defines a space (22) therebetween for receiving the lower end of an arm (3). Bottom surface of the cap (2) is formed with a rib (23) positioned between the two walls (21) and provided with a pair of channels (24). After the cap (2) is totally combined with the base (1), the channels (24) and the channels (13) of the base (1) become a pair of perfect cylindrical holes, each of which has slightly smaller diameter than the diameter of the pins. Thus, the holes can fixedly engage with the pins.

A flat curved form of the arm (3) in the drawings of this invention is only an exemplary figure, which can be replaced by any other expected form without limitation. The lower end of the arm (3) inserts into the space (22) defined by the base (1) and the cap (2) and combines with the base (1). Bottom surface of the lower end of the arm (3) is provided with a pair of slots (31) which extends along from the lower end to the upper end of the arm (3). Slots (31) receive a pair of wires (32) therein. Both ends of the wires (32) stretch out from the arm (3) to insert into respective pins (15) and (45) of the base (1) and a shade (4). Power supply is therefore transmitted along the wires (32) of the arm (3) from the base (1) to the shade (4) for lighting a lamp or a bulb.

Bottom side of the aforesaid shade (4) is provided with a pair of channels (41) to contain a pair of pins (45) which connect with respective wires (44). Other ends of the wires (44) are connected with a seat (46) which combines with a lamp or a bulb (not shown). A plate (5) is connected with the shade (4) in any expected way, and provided with a pair of protrusions (50) with a respective channels (51) thereon, by which a pair of perfect cylindrical holes are completed with the channels (41) of the shade (4). And the holes are capable of tightly engaging with pins (45) which have a larger diameter than the holes. The plate (5) not only fixes the pins, but also defines a space (52) between the shade (4) and itself to allow the insertion of upper end of the arm (3). As the arm (3) inserts into the shade (4), the wires (32) also connects with the pins (45); whereby the combination of both is completed.

It is to be understood that the assembly of this desk lamp (10) is very easy, to insert the lower end of the arm into the base and the upper end into the shade, without requiring tools. On the other hand, it is also convenient to disassemble the desk lamp in reversed process.

As various possible embodiments might be made of the above invention without departing from the scope of the invention, and it is to be understood that all matter herein described or shown in the accompanying drawings is to be interpreted as illustrative and not in a limiting sense. Thus it will be appreciated that the drawings are exemplary of a preferred embodiment of the invention.

I claim:

1. A desk lamp capable of easy assembly and disassembly comprising:

a) a base having an upper portion, a hole formed in the upper portion, a flange surrounding the hole, a pair of channels formed in the flange, a pair of first pins disposed within the channels, a pair of wires connected to the pins, a cap having two sidewalls defining a space therebetween for covering the hole, a rib extending outwardly from a bottom portion of the cap, the rib having a pair of corresponding channels formed therein for enclosing the pins when the cover is secured to the base, and the sidewalls of the cap defining a first space therebetween;

b) a shade having a bottom portion, a pair of channels formed in the bottom portion for receiving a pair of second pins, a plate having a pair of protrusions, each protrusion including a corresponding channel formed therein for enclosing a second pin when the plate is secured to the shade, and the plate and shade defining a second space therebetween; and c) an arm having first and second opposite ends, a pair of wires extending along the arm and terminating in first and second pairs of wire ends at the corresponding first and second opposite ends of the arm, the first pairs of wire ends being detachably received within the first pair of pins and the first end of the arm being receivable within the first space, and the second pair of wire ends being detachably receivable within the second pair of pins and the second end of the arm being detachably receivable within the second space.

2. The desk lamp of claim 1 wherein the arm includes a pair of channels extending along a bottom side thereof, and the pair of wires are disposed within the channels.

* * * * *